United States Patent [19]

Morgan et al.

[11] Patent Number: 4,975,667

[45] Date of Patent: Dec. 4, 1990

[54] MOLDED CASE CIRCUIT BREAKER WITH INCREASED AMPERE RATING

[75] Inventors: Roger J. Morgan, Simsbury; Thomas F. Papallo, Jr., Plainville; Irenaeus S. Panus, Forestville; Ronald G. Pekrul, Southington, all of Conn.

[73] Assignee: General Electric Company, New York, N.Y.

[21] Appl. No.: 400,843

[22] Filed: Aug. 30, 1989

[51] Int. Cl.[5] ..... H01H 9/02

[52] U.S. Cl. ..... 335/202; 200/293; 200/303; 361/376

[58] Field of Search ..... 361/93, 346, 351, 353, 361/363, 376; 200/294, 295, 293, 303, 304; 335/7-10, 16, 202

[56] References Cited

U.S. PATENT DOCUMENTS 4,589,052 5/1986 Dougherty ..... 361/94
4,649,455 3/1987 Scott ..... 361/93
4,754,247 6/1988 Raymont et al. ..... 335/202

OTHER PUBLICATIONS

Ser. No. 330,521 Entitled "Molded Case Circuit Breaker Movable Contact Arm Arrangement", filed 3/30/89, Seymour et al.

*Primary Examiner*—Gregory D. Thompson
*Attorney, Agent, or Firm*—Richard A. Menelly; Walter C. Bernkopf; Fred Jacob

[57] ABSTRACT

An electric circuit breaker enclosure includes a pultruded glass-filled plastic inset for added strength to the line and load terminal straps. The line and load terminal straps are fastened to the inset on the side and receive the corresponding line and load terminal cables on an opposite side thereof. The inset allows connection within a high-rated electrical power distribution circuit without damage to the circuit breaker case upon short circuit interruption.

9 Claims, 3 Drawing Sheets

MOLDED CASE CIRCUIT BREAKER WITH INCREASED AMPERE RATING

BACKGROUND OF THE INVENTION

U.S. Pat. No. 4,754,247 entitled "Molded Case Circuit Breaker Accessory Enclosure" describes a so-called "integrated" circuit breaker that provides both circuit interruption as well as accessory function. This Patent is incorporated herein for reference purposes and should be reviewed for its disclosure of an accessory cover mounted on the circuit breaker cover for providing access to field-installable accessory devices. The integrated circuit breaker includes anintegrated circuit electronic trip unit which allows one circuit breaker design to be used over a wide range of ampere ratings in combination with a rating plug, also mounted in the circuit breaker cover. The electronic trip unit is described within U.S. Pat. No. 4,589,052 and the rating plug is described within U.S. Pat. No. 4,649,455 both of which are incorporated herein for reference purposes.

The use of common circuit breaker components over a wide variety of ampere ratings could provide a strain on the circuit breaker case in the vicinity of the line and load terminal straps upon short circuit interruption when operated at high ampere loadings. The large electrodynamic forces exerted between adjacent line terminal straps and between adjacent load terminal straps exert corresponding large stress forces to the underlying case to which the line and load terminal straps are secured.

One purpose of the instant invention accordingly is to provide a reinforced circuit breaker case to enable an integrated circuit breaker to respond to high ampere short circuit overcurrent conditions without damaging the circuit breaker case.

SUMMARY OF THE INVENTION

The invention comprises a molded case circuit breaker having reinforcement insets underlying the line and load terminal straps. The insets are formed from a pultrusion of glass fibers within a polyester plastic resin. The line and load terminal straps are fastened to the underlying insets such that forces generated within the line and load terminal connectors are resisted by the high strength pultruded polyester-glass material.

DESCRIPTION OF THE PREFERRED EMBODIMENT

Figure 1:
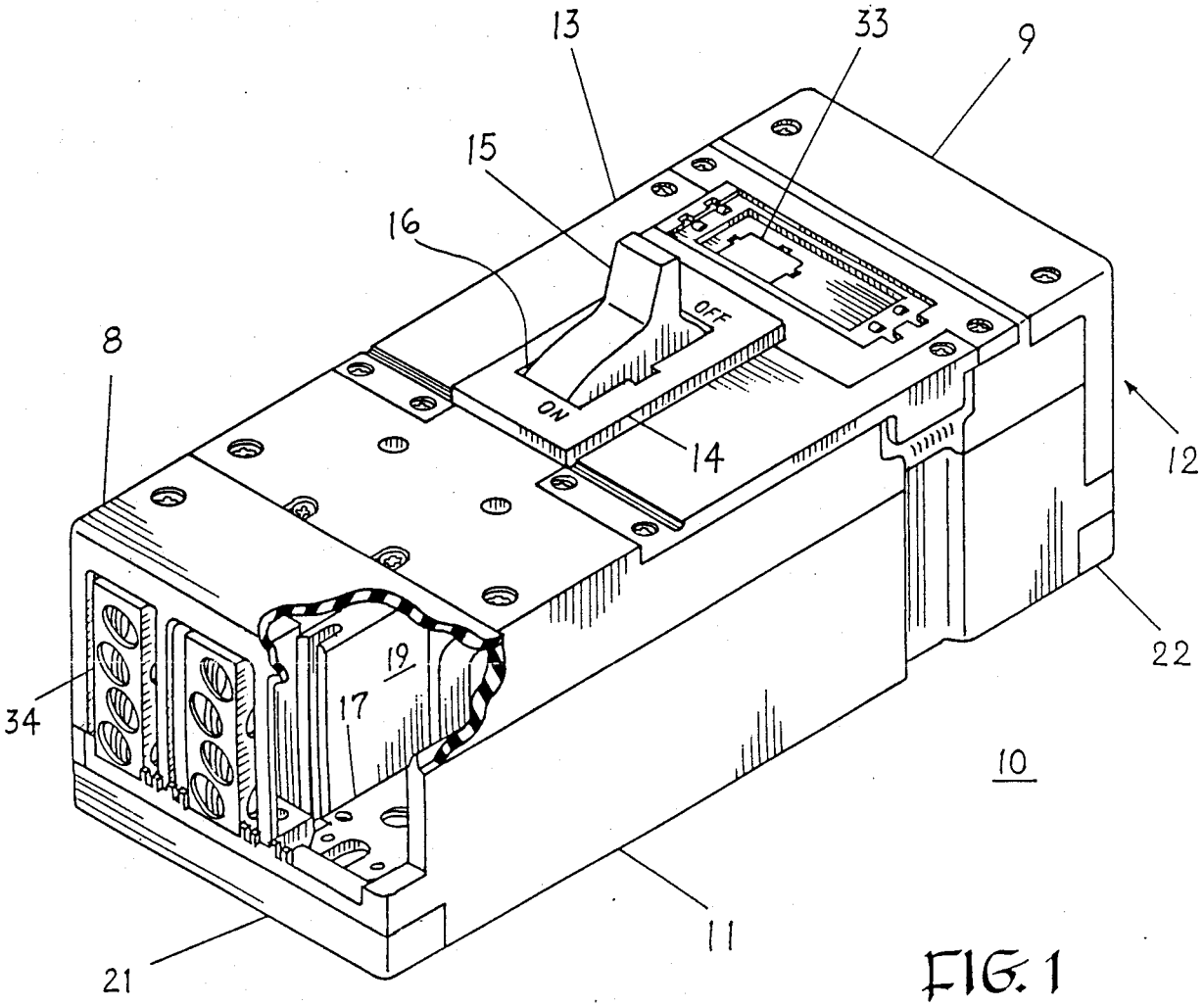
FIG. 1 is a top perspective view of a molded case circuit breaker employing the reinforcement inserts in accordance with the invention.

An integrated circuit breaker 10 is shown in FIG. 1 and consists of a molded plastic case 11 to which a molded plastic cover 12 is attached. An accessory cover 13 as described in the aforementioned U.S. Pat. No. 4,754,247 is arranged on the top of the cover around the handle escutcheon 14 through which the handle operator 15 extends through the handle slot opening 16. The rating plug 33 is also accessible from the circuit breaker cover to allow the ampere rating of the circuit breaker to be adjusted as described within aforementioned U.S. Pat. No. 4,649,455. Electrical connection with an industrial power distribution circuit is made by means by the line terminal straps 17 that are supported upon a line terminal inset 21. A pair of integrally-formed shields 19 electrically isolate the line terminal straps connected with the separate phases of a multi-phase power distribution circuit. A similar load terminal inset 22 is arranged on the opposite end of the circuit breaker under the load terminal straps 27 and load terminal lugs 35 (FIG. 2) and insulative line terminal lug covers and load terminal lug covers 8, 9 are arranged over the respective line and load terminal lugs 34, 35.

Figure 2:
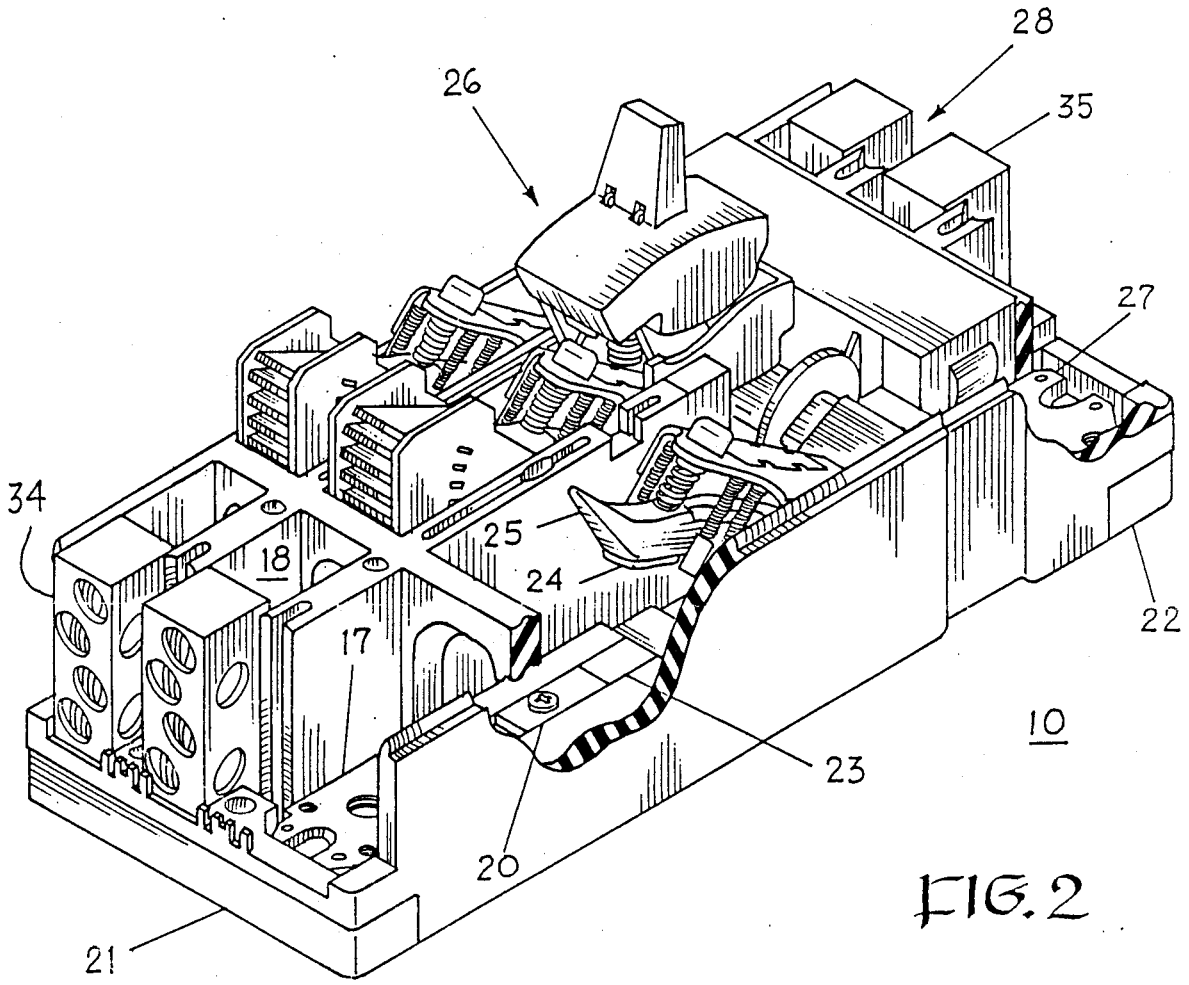
FIG. 2 is a top perspective view of the circuit breaker of FIG. 1 with the cover removed.

The circuit breaker 10 is depicted in FIG. 2 with the cover removed to show the circuit breaker operating mechanism 26 which is better described in U.S. Patent Application Ser. No. 330,521 filed Mar. 30, 1989 entitled "Molded Case Circuit Breaker Movable Contact Arm Arrangement" which Application is incorporated herein for purposes of reference. The circuit current transfers between the line terminal lugs 34 and line terminal straps 17 that are arranged within the line terminal compartment 18 at one end, through the fixed contact supports 20 and fixed contacts 23. The fixed contacts transfer current to the movable contacts 24 that are arranged on the movable contact arms 25 and which connect with the load terminal straps 27 and load terminal lugs 35 arranged within the load terminal compartment 28. Upon the occurrence of an overcurrent condition, the operating mechanism lifts the movable contact arms 25 to rapidly separate the fixed and movable contacts 23, 24 and thereby separate the circuit existing between the line and load terminal lugs. As described earlier, the line terminal straps 17 are directly attached to the line terminal inset 21 and the load terminal straps 27 are directly attached to the load terminal inset 22.

Figure 3:
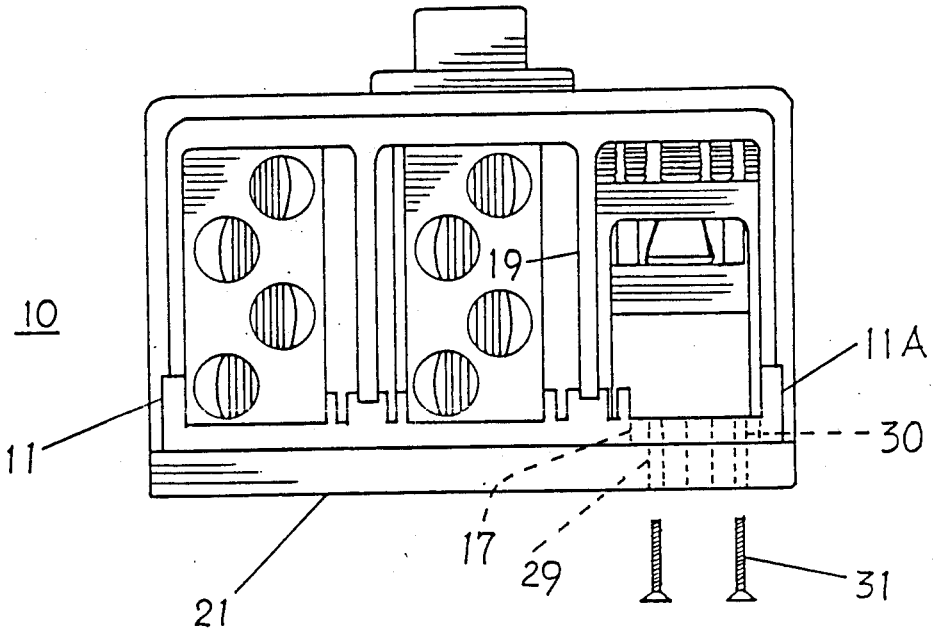
FIG. 3 is an enlarged end view of the circuit breaker depicted in FIGS. 1 and 2.

The attachment between the line terminal straps can best be seen by now referring to the circuit breaker 10 depicted in FIG. 3. The circuit breaker case 11 which is formed from a molded composition which includes a glass-filled polyester resin, is substantially reinforced by the provision of the rectangular line terminal inset 21 which is formed from a pultrusion of glass fibers within a polyester resin. For purposes of this disclosure, "pultrusion" means the extrusion of continuous strands of glass fiber within a polyester resin material wherein essentially all the glass fibers extend in the same direction. The mechanical strength of such a pultrusion is substantially higher than commonly extruded polyester resins. Such pultruded polyesters can be obtained, for example, from the Haysite Company, Erie, Pa. The line terminal inset 21 is attached to the base portion 11A that underlies the line terminal straps 17 by means of thru-holes 29 extending through the line terminal inset and base portion 11A and through the threaded openings 30 formed in the bottom of the line terminal straps 17. The screws 31 engage the threaded openings 30 to tightly fasten the line terminal straps to the base and line terminal insets. The corresponding provision of load terminal insets on the load end of the circuit breaker case to support the load terminal straps allows the circuit breaker to be employed over a wide range of ampere ratings without damage to the line or load terminal straps or the underlying portion of the circuit breaker base that could otherwise occur during short circuit interruption.

Having thus described our invention, what we claim as new and desire to secure by Letters Patent is:

1. A molded case circuit breaker comprising:

a plastic case and cover;

a pair of separable contacts within said case and arranged for separation by automatic operation of a spring-powered operating mechanism to interrupt circuit current through said contacts upon occurrence of an overcurrent condition;

a plurality of load lugs arranged at a load end of said case;

a corresponding plurality of line lugs arranged at a line end of said case; and a planar glass-filled plastic inset fastened to said case subjacent said load lugs.

2. The circuit breaker of claim 1 including a planar glass-filled plastic inset fastened to said case subjacent said line lugs.

3. The circuit breaker of claim 1 wherein said plastic comprises polyester.

4. The circuit breaker of claim 1 wherein said glass comprises glass fibers.

5. The circuit breaker of claim 4 wherein said glass fibers are aligned along a common axis.

6. The circuit breaker of claim 4 wherein said glass fibers are pultruded within said plastic.

7. The circuit breaker of claim 2 wherein both said plastic insets include a clearance opening for a retainer screw.

8. The circuit breaker of claim 7 including a threaded opening through said case subjacent said line lugs.

9. The circuit breaker of claim 7 including a threaded opening through said case subjacent said load lugs.

* * * * *